US009534472B2

(12) United States Patent
Marya et al.

(10) Patent No.: US 9,534,472 B2
(45) Date of Patent: Jan. 3, 2017

(54) FABRICATION AND USE OF WELL-BASED OBSTRUCTION FORMING OBJECT

(71) Applicant: Schlumberger Technology Corporation, Sugar Land, TX (US)

(72) Inventors: Manuel P. Marya, Sugar Land, TX (US); Timothy R. Dunne, Missouri City, TX (US); Tatiana Reyes Hernandez, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 577 days.

(21) Appl. No.: 13/719,694

(22) Filed: Dec. 19, 2012

(65) Prior Publication Data

US 2014/0166316 A1 Jun. 19, 2014

(51) Int. Cl.
*E21B 34/14* (2006.01)

(52) U.S. Cl.
CPC ..... *E21B 34/14* (2013.01)

(58) Field of Classification Search
CPC ..... E21B 34/14
See application file for complete search history.

(56) References Cited

U.S. PATENT DOCUMENTS

| | | | | |
|---|---|---|---|---|
| 3,254,849 | A | 6/1966 | Clements | |
| 3,283,376 | A | 11/1966 | Hockin | |
| 3,437,147 | A * | 4/1969 | Davies | C09K 8/72 166/193 |
| 3,691,704 | A | 9/1972 | Novak | |
| 4,505,334 | A | 3/1985 | Doner et al. | |
| 4,522,397 | A | 6/1985 | Miller, Jr. et al. | |
| 5,253,709 | A * | 10/1993 | Kendrick | E21B 33/138 166/193 |
| 5,667,154 | A | 9/1997 | Hand | |
| 5,941,309 | A * | 8/1999 | Appleton | E21B 23/006 137/71 |
| 7,377,321 | B2 | 5/2008 | Rytlewski | |
| 7,624,810 | B2 | 12/2009 | Fould et al. | |
| 7,775,279 | B2 | 8/2010 | Marya et al. | |
| 8,211,247 | B2 | 7/2012 | Marya et al. | |
| 8,211,248 | B2 | 7/2012 | Marya | |
| 8,851,172 | B1 * | 10/2014 | Dudzinski | E21B 33/138 166/193 |
| 2007/0166541 | A1 | 7/2007 | Smith et al. | |
| 2012/0006562 | A1 | 1/2012 | Speer et al. | |
| 2012/0118583 | A1 | 5/2012 | Johnson et al. | |
| 2012/0168163 | A1 | 7/2012 | Bertoja et al. | |
| 2013/0032357 | A1 * | 2/2013 | Mazyar | E21B 41/00 166/376 |

* cited by examiner

*Primary Examiner* — Brad Harcourt
(74) *Attorney, Agent, or Firm* — Jeffery R. Peterson

(57) ABSTRACT

An apparatus that is usable within a well includes a string and an object. The object is adapted to be communicated into the well through a passageway of the string to form an obstruction downhole in the well. The object includes an inner core; a layer to surround the inner core; and a structure to extend from the layer to support the inner core while the layer is being formed to position the inner core with respect to the layer.

20 Claims, 8 Drawing Sheets

FABRICATION AND USE OF WELL-BASED OBSTRUCTION FORMING OBJECT

BACKGROUND

An object, such as a ball, dart, plug or bar, may be deployed into a well to form an obstruction for such purposes as activating a downhole tool, diverting a downhole fluid flow and/or forming a temporary plug between stages, or zones, of the well. For example, an object may be pumped into a well for purposes of lodging in a seat of an operator of a downhole tool, such as a valve, so that the resulting pressure may be used to shift the valve to an open or closed state. As another example, an object may be pumped into a well to a certain downhole location for purposes of diverting a fracturing fluid from a tubing string into a surrounding formation. A given object may be used for multiple functions, such as, for example, when an object is used to shift a fracturing valve open and divert a fracturing fluid flow through radial ports of the open valve.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In an example implementation, an apparatus that is usable within a well includes a string and an object. The object is adapted to be communicated into the well through a passageway of the string to form an obstruction downhole in the well. The object includes an inner core; a layer to surround the inner core; and a structure to extend from the layer to support the inner core while the layer is being formed to position the inner core with respect to the layer.

In another example implementation, an apparatus includes a string and an object. The object is adapted to be communicated into a well through a passageway of the string to form an obstruction downhole in the well. The object includes an inner core; and one or several layers to surround the inner core. The object may have an asymmetric dynamic characteristic to regulate delivery of the object downhole.

In another example implementation, an apparatus that is usable within a well includes a string and an object. The object is adapted to be communicated downhole in the well via a passageway of the string. The object includes a first piece having at least a partial spherical shape; a second piece having at least a partial spherical shape; and a relatively flat piece friction welded to the first and second pieces using rotation of the flat piece relative to the first and second pieces.

In another example implementation, a technique that is usable within a well includes forming an object to be deployed into a well to form an obstruction in the well. The forming includes providing an inner core; using a structure to suspend the inner core relative to a region in which a layer that surrounds the inner core is formed; and forming the layer to surround the inner core. The formed layer at least partially incorporates the structure.

In another example implementation, an apparatus that is usable within a well includes a string to be deployed in the well and an object to be deployed downhole to form an obstruction in a passageway of the string. The object includes a foam-based material.

In another example implementation, a technique includes forming a first object to be communicated downhole in a well to form an obstruction in the well. The formation of the first object includes suspending a second object over a fluidized bed and coating the suspended second object with a material. The formation further includes applying thermal energy to remove at least one of the second object and a binder of the material that coats the suspended object.

In yet another example implementation, an apparatus that is usable within a well includes a string to be deployed in the well and an object to be deployed downhole to form an obstruction in a passageway of the string. The apparatus includes a cluster of objects having centers of mass offset with respect to a center of mass of the cluster.

Advantages and other features will become apparent from the following drawings, description and claims.

DETAILED DESCRIPTION

In the following description, numerous details are set forth to provide an understanding of features of various embodiments. However, it will be understood by those skilled in the art that the subject matter that is set forth in the claims may be practiced without these details and that numerous variations or modifications from the described embodiments are possible.

As used herein, terms, such as "up" and "down"; "upper" and "lower"; "upwardly" and downwardly"; "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate.

Systems and techniques are disclosed herein for purposes of fabricating objects (also referred to herein as "obstruction forming objects") that may be communicated (pumped, for example) downhole into a well to form obstructions for various downhole purposes. These objects may take on numerous forms, such as darts, spheres (or "balls"), bars, plugs and members of other shapes.

A given object may be, as examples, an activation ball that is used to activate a downhole tool; a diverter ball that is used to divert a downhole flow; a plug that is used to isolate zones; and so forth. Moreover, the object may be used in a wide variety of well operations, such as stimulation operations, multiple stage fracturing operations, acidizing operations, treatment operations, intervention operations, perforating operations, and so forth.

The obstructing forming objects that are disclosed herein have certain properties (weight, rotational characteristic, material properties, and so forth), which may provide one or more of the following advantages. The objects may be readily pumped downhole into the well even through relatively small diameter tubing. In this manner, when the breadth of the object (its diameter, for example) is comparatively significantly smaller than the bore diameter through the tubing string in which the object is communicated, the pumping or flowing of the object downhole may be quite challenging, especially with wells that have a high number (greater than twenty-four, as an example) of stages. Objects are disclosed herein, which may be readily communicated through relatively small passageways that may be present due to telescoping (and progressively narrowing) arrangement of tubing string diameters. As further disclosed herein, the objects may have other advantages, such as relatively rapid disintegration after performing intended downhole functions. Moreover, the objects may be readily mass produced. Other and different advantages are contemplated, as will become apparent from the following description.

Figure 1:
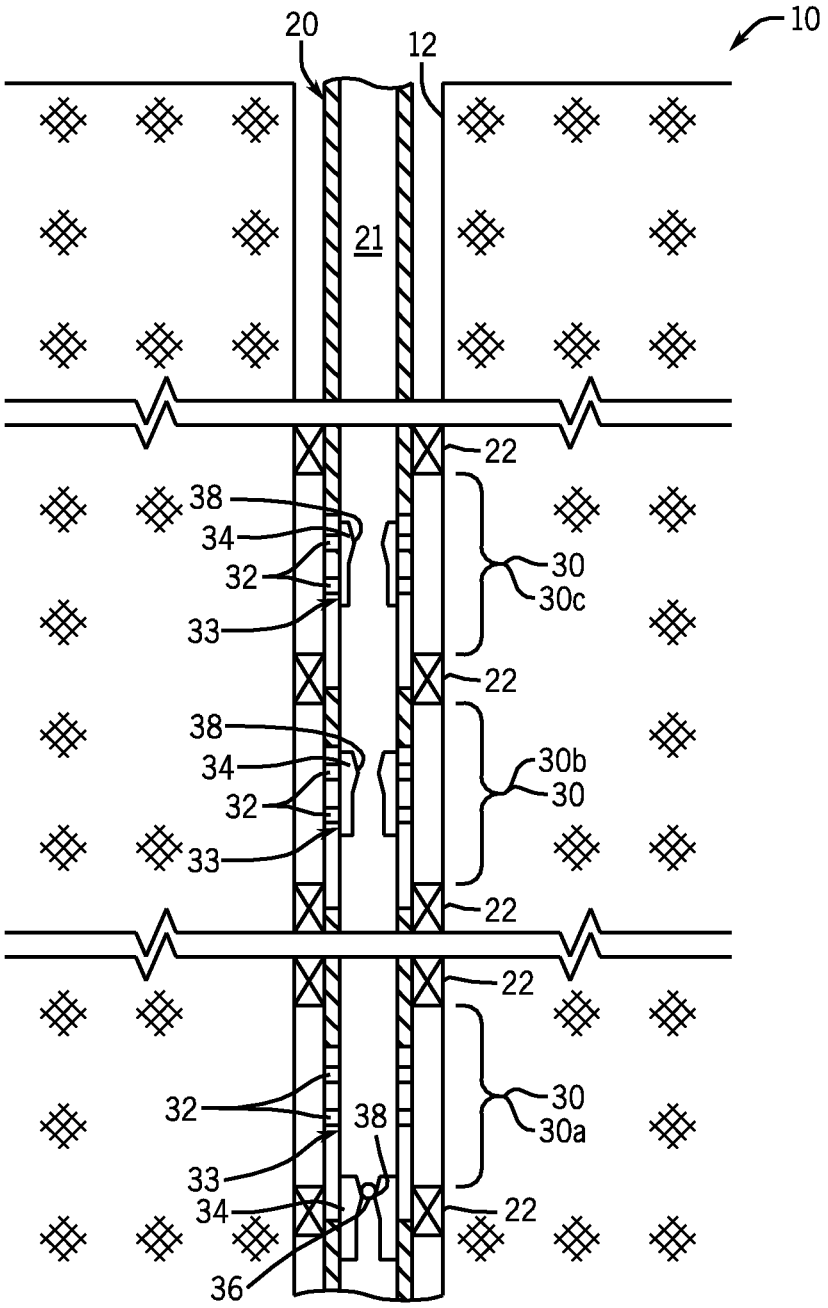
FIG. 1 is a schematic diagram of a well according to an example implementation.

As a more specific example, an obstruction forming object may be used in a well 10 that is depicted in FIG. 1. For this example, the well 10 includes a wellbore 12, which extends through one or more reservoir formations. Although depicted in FIG. 1 as being a main vertical wellbore, the wellbore 12 may be a deviated or horizontal wellbore, in accordance with further implementations.

As depicted in FIG. 1, a tubing string 20 extends into the wellbore 12 and includes packers 22, which are radially expanded, or "set," for purposes of forming corresponding annular seal(s) between the outer surface of the tubing string 20 and the wellbore wall. The packers 22, when set form corresponding isolated zones 30 (zones 30*a*, 30*b* and 30*c* being depicted in FIG. 1, as non-limiting examples), in which may be performed various completion operations. In this manner, after the tubing string 20 is run into the wellbore 12 and the packers 22 are set, completion operations may be performed in one zone 30 at a time for purposes of performing such operations as fracturing, stimulation, acidizing, etc., depending on the particular implementation.

For the example of FIG. 1, for purposes of selecting a given zone 30 for an operation, the tubing string 20 includes tools that are selectively operated using exemplary activation balls 36 (i.e., exemplary obstruction forming objects). For the particular non-limiting example depicted in FIG. 1, the downhole tools that are activated by the activation balls 36 are sleeve valves 33. In general, for this example, each sleeve valve 33 is associated with a given zone 30 and includes a sleeve 34 that is operated via an activation ball 36 to selectively open the sleeve 34. In this regard, in accordance with exemplary implementations, the sleeve valves 33 are all initially configured to be closed in their run-in-hole states.

When closed (as depicted in zones 30*b* and 30*c*), the sleeve 34 covers radial ports 32 (formed in a housing 35 of the sleeve valve 33, which is concentric with the tubular string 30) to block fluid communication between a central passageway 21 of the tubular string 20 and the annulus of the associated zone 30. Although not shown in the figures, the sleeve valve 33 has associated seals (o-rings, for example) for purposes of sealing off fluid communication through the radial ports 32. The sleeve valve 33 may be opened by deployment of a given activation ball 36, as depicted in zone 30*a* of FIG. 1. The activation involves the activation ball 36 lodging in a ball catching seat 38 of the sleeve valve 34, which causes a force to develop to shift the valve 34 open.

Referring to FIG. 1, in accordance with an exemplary implementation, the ball catching seats 38 of the sleeve valves 33 are graduated such that the inner diameters of the seats 38 become progressively smaller from the surface of the well toward the end, or toe, of the wellbore 12. Due to the graduated openings, a series of varying diameter activation balls 36 may be used to select and activate a given sleeve valve. In this manner, for the exemplary arrangement described herein, the smallest outer diameter activation ball 36 is first deployed into the central passageway 21 of the tubular string 20 for purposes of activating the lowest sleeve valve. For the example depicted in FIG. 1, the activation ball 36 that is used to activate the sleeve valve 33 for the zone 30*a* is thereby smaller than the corresponding activation ball 36 (not shown) that is used to activate the sleeve valve 33 for the zone 30*b*. In a corresponding manner, an activation ball 36 (not shown) that is of a yet larger outer diameter may be used activate the sleeve valve 33 for the zone 30*c*, and so forth.

Although FIG. 1 depicts a system of varying, fixed diameter ball catching seats 38, other systems may be used in accordance with other implementations. For example, in accordance with other example implementations, a tubing string may contain valve seats that are selectively restricted to be placed in "object catching states," such as the system disclosed in, for example, U.S. Pat. No. 7,377,321, entitled, "TESTING, TREATING, OR PRODUCING A MULTI-ZONE WELL," which issued on May 27, 2008. As yet another example, an object catching seat may be formed by perforating a designated region of a downhole tool, as disclosed in, U.S. patent application Ser. No. 13/197,450, entitled, "METHOD AND APPARATUS FOR COMPLETING A MULTI-STAGE WELL," which was filed on Aug. 3, 2011, and is hereby incorporated by reference in its entirety.

The obstruction forming object need not be pumped from the Earth surface of the well. For example a given object may be conveyed into the well by a tool and retained in the tool until the tool releases the object as disclosed in, for example, U.S. Pat. No. 7,624,810, entitled, "BALL DROPPING ASSEMBLY AND TECHNIQUE FOR USE IN A WELL," which issued on Dec. 1, 2009.

Regardless of the particular system used with the obstruction forming object, in accordance with example implementations, a tubing string includes a passageway through which an obstruction forming object at least partially traverses for purposes of forming an obstruction to perform a downhole function. Thus, many variations are contemplated, which are within the scope of the appended claims.

In accordance with example implementations that are disclosed herein, an obstruction forming object, such as the activation ball 36 of FIG. 1, may be fabricated to have characteristics, which enhance the use of the object within a well, such as features that enhance delivery of the object downhole and features that contribute to the degradation of the object after the object performs its intended downhole function. Although obstruction forming objects having spherical, or ball-like, shapes are generally disclosed and discussed below, it is understood that the systems and techniques that are disclosed herein may likewise be applied to obstruction forming objects having other shapes (darts or bars, for example), as can be appreciated by the skilled artisan.

Figure 2:
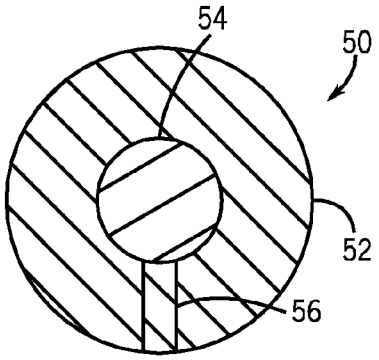
FIGS. 2 and 5 are cross-sectional views of balls that may be used to form an obstruction in a well according to example implementations.

As a more specific example, the ball's low weight is at least one factor that permits the ball to be readily communicated through relatively narrow (i.e., small inner diameter) tubing. In this manner, in accordance with an example implementation, the ball has a low density core (a hollow core or a core formed from a relatively low density material, such as aluminum or another lightweight metal or metal foam, for example) and one or more degradable and higher density outer layers. FIG. 2 depicts a multiple layer ball 50 that has such a lightweight construction, in accordance with an example implementation.

Referring to FIG. 2, the ball 50 includes a relatively low density inner core 54 that is surrounded by one or more higher density outer layers 52 (a single outer layer 52 being depicted for the example of FIG. 2). In accordance with an example implementation, the outer layer(s) 52 are formed from a degradable material. As examples, the degradable material may be an Al—Ga-based alloy, an Al—Mg-based alloy or in general, any of the degradable materials disclosed in U.S. Pat. No. 7,775,279, entitled, "DEBRIS-FREE PERFORATING APPARATUS AND TECHNIQUE," which issued on Aug. 17, 2010; U.S. Pat. No. 8,211,247, entitled, "DEGRADABLE COMPOSITIONS, APPARATUS COMPRISING SAME, AND METHOD OF USE," which issued on Jul. 3, 2012; or U.S. Pat. No. 8,211,248, entitled, "AGED-HARDENABLE ALUMINUM ALLOY WITH ENVIRONMENTAL DEGRADABILITY, METHODS OF USE AND MAKING," which issued on Jul. 3, 2012. Other degradable materials may be used, in accordance with other implementations.

The inner core 54 may be a relatively porous material, such as a ceramic (alumina or an alumina compound, as examples); a lightweight polymeric material (polystyrene, for example); or a lightweight metal (aluminum, for example). Moreover, in some example implementations, the inner core 54 may be a fluid, such as air (i.e., the activation ball 50 may be hollow).

In some example implementations, the inner core 54 may be degradable or have other characteristics (e.g., the inner core 54 may be frangible (made from a ceramic material as an example), which aid in removing the obstruction created by the ball 50 after the ball 50 performs its intended downhole function and the outer layer 52 is removed.

The outer layer(s) 52 may be formed in numerous different ways, depending on the particular implementation. In accordance with an example implementation, the outer layer(s) 52 may be formed using a mold, in conjunction with metal powder sintering or liquid metal casting. In this manner, in accordance with an example implementation, a given outer layer 52 may be formed by positioning the inner core 54 inside a mold for the sintering/casting to follow using a suspension structure. The suspension structure, which is attached to the inner core 54 prior to the introduction of the metal power/liquid metal into the mold, remains as part of the final, fabricated ball 50 after the sintering/casting of the outer layer 52 is complete.

Figure 3:
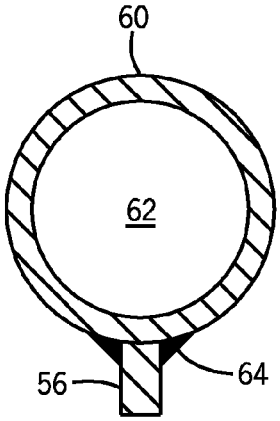
FIG. 3 is a cross-sectional view of an intermediate state of the ball during fabrication of the ball according to an example implementation.

As a more specific example, FIG. 3 depicts an intermediate stage in the fabrication process for a ball in accordance with an example implementation. For this example, the ball is fabricated with a hollow inner core, which is formed from a spherical shell 60 (a ceramic shell, for example), which has an interior void or space 62. For purposes of suspending the inner core 60 during the manufacturing process so that an outer layer 52 may be formed about the shell 60, at least one structure is attached to the outside of the shell 62. For the example of FIG. 3, a single structure 56, such as a rod, is attached (by a metal weld 64 or alternatively by other attachment means, such as braising, adhesive and so forth) to the exterior surface of the shell 60.

Figure 4:
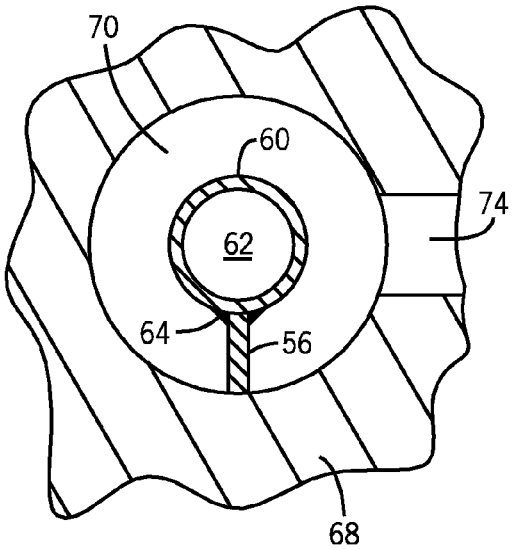
FIG. 4 is a cross-sectional view illustrating positioning of an inner core of a ball inside a mold used to fabricate the ball according to an example implementation.

Referring to FIG. 4, due to the structure(s) 56, the shell 60 is spaced away from the wall of a mold 69 during the sintering/casting of the outer layer 52. In this regard, as depicted in FIG. 4, the structure(s) 56 rests on the wall of the mold 69, which defines the metal powder/liquid metal receiving cavity 70 to suspend the shell 60 inside the cavity 70 at the appropriate position. For the example of FIG. 4, the structure(s) position the shell 60 so that the shell 60 is in the center of the cavity 70. With the shell 60 being in place, metal powder or liquid metal (depending on the fabrication process used to form the outer layer(s)) may be introduced (via a passageway 74 of the mold 69, for example) into the cavity 70 for purposes of forming the outer layer 52 of the ball. The process may be repeated using larger molds to form additional outer layers of the ball.

Figure 5:
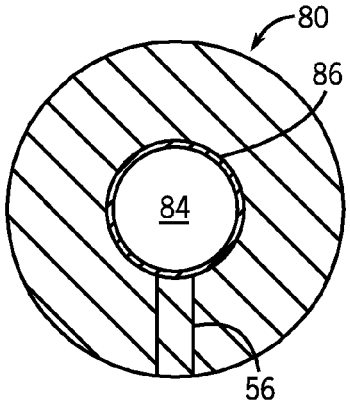

As a more specific example, FIG. 5 depicts a ball 80 that has been fabricated using the above-described suspension structure. For this example, the ball 80 includes a relatively thin inner shell 86 (having an internal void 84) about which an outer layer 85 has been formed. As shown in FIG. 5, the outer layer 85 at least partially encompasses the support structure(s) 56 in the final, fabricated ball 80.

As an example, the material that is used to form the outer layer 85 may be the same material used to form the support structure(s) 56, in accordance with example implementations; and as such, in example implementations, the support structure(s) 56 and the outer layer 85 may both be formed from degradable materials. In other implementations, the structure(s) 56 may be formed from a degradable material that is different than the degradable material forming the outer layer(s) 85. In another variation, the structure(s) 56 may be formed from a non-degradable material.

In further implementations a ball may be formed from an inner core forming structure that may be dissolved or melted during the fabrication process. In this regard, the inner core forming structure provides support for forming the outer layer(s) and creating the inner core during the fabrication process. As part of this process, the inner core forming structure may be removed, degraded or reduced in size after being used to form the outer layer(s).

For example, to form a hollow ball, the inner core forming structure may be a spherically-shaped wax that is melted (melted by, for example, applying thermal energy). The melted wax may flow through pores of the outer layer(s) and thus, may be removed from the ball in the fabrication process. As another example, the inner core structure may be formed from a polymeric material (polystyrene, for example), which is melted and removed in the fabrication process. In other implementations, the inner core forming structure may be a frangible material (a ceramic material, for example), such as a shell (shell 60 depicted in FIG. 3, for example), that simply collapses into fragments due to external pressure. In this manner, an inner shell (such as the shell 60) may be part of the final, fabricated ball and constructed to collapse as soon as a sufficient amount of the surrounding degradable material has been removed in the well environment. As a more specific example, the integrity of the inner shell is preserved as long as the shell is in a relatively low pressure environment (15 pounds per square inch (psi) or 1 atmosphere (atm) pressure, as an example). After a sufficient amount of degradable material of the ball is removed in the well, the shell becomes exposed to the well pressure (a pressure greater than 1000 psi, for example), which causes the shell to collapse.

In further implementations, the ball may contain a frangible inner shell that may be shattered as part of the fabrication process. For example, the shell may be shattered by striking the ball after the outer layer(s) are formed. Although fragments of such a frangible inner core forming structure remain inside the completed ball, the occupied volume is substantially reduced.

Figure 6:
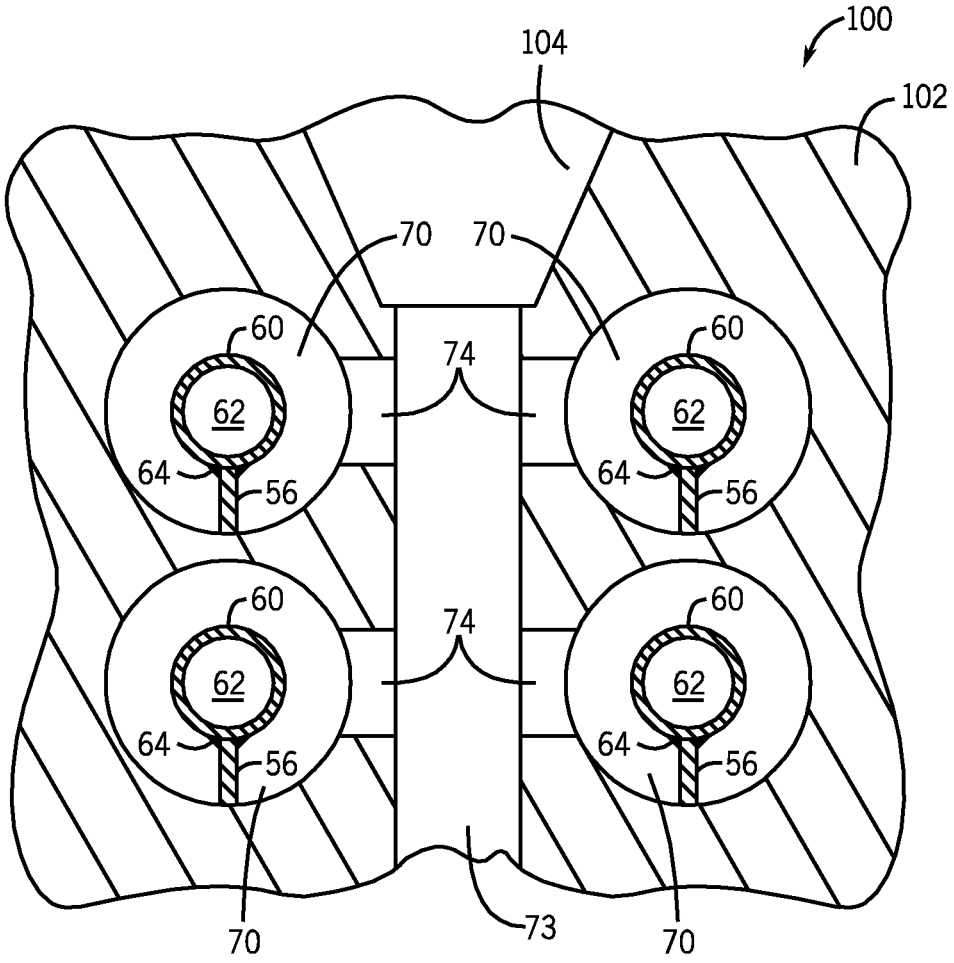
FIG. 6 is a cross-sectional view of a mold illustrating concurrent fabrication of multiple balls according to an example implementation.

FIG. 6 depicts a mold 100 in which multiple balls may be concurrently formed by casting or sintering. In the case of a sintering process, features of FIG. 6, such as communication passageways 73 and 74, may not be used, in accordance with some implementations. The mold 100 includes central passageway 105 that is fed with liquid metal or alloy, or a mix of metal powders as in the case of sintering, through a central opening 104 and is in communication with various cavities 70 (via the passageways 73 and 74, for example) that contain the inner cores 70 as well as the suspending structures 56 so that the liquid metal/metal powder may be introduced about the cores 60 to concurrently form the outer layers of multiple balls.

Figure 7:
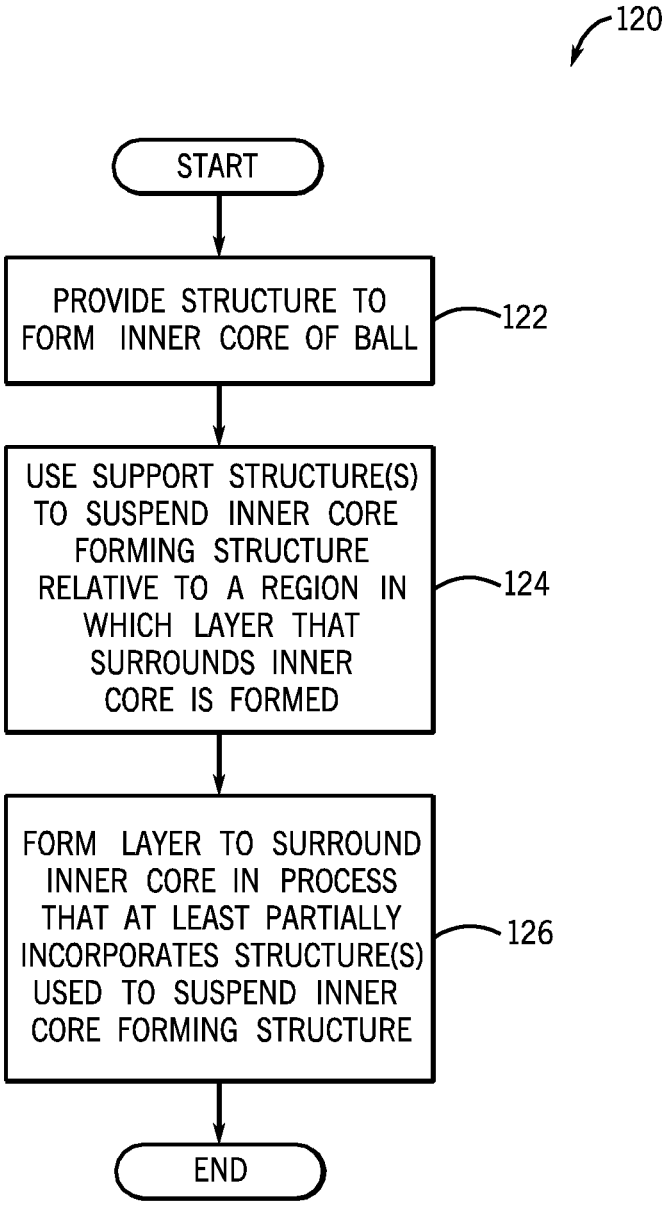
FIG. 7 is a flow diagram depicting a technique to fabricate a ball according to an example implementation.

Thus, referring to FIG. 7, in accordance with example implementations, a technique 120 includes providing (block 122) a structure to form an inner core of a ball and using (block 124) one or more support structures to suspend the outer core forming structure relative to a region in which a layer that surrounds the inner core is formed. Pursuant to the technique 120, a layer to surround the inner core is formed (block 126) in a process that at least partially incorporates the structure(s) used to suspend the inner core forming structure.

In accordance with example implementations, an obstruction forming object may be formed that has an asymmetric dynamic characteristic to regulate the delivery of the object into the well. For example, a ball may be designed to induce rotation of the ball as the ball is being communicated (pumped, for example) into the well. Such a rotation may be beneficial for such purposes as controlling the drop velocity of the ball, controlling the travel distance of the ball, and so forth. One way to induce rotation for a ball is to eccentrically position an inner core of the ball with respect to the overall center of mass of the ball. An exemplary ball 150 that has an eccentrically-positioned inner core is depicted in FIG. 8.

Figure 8:
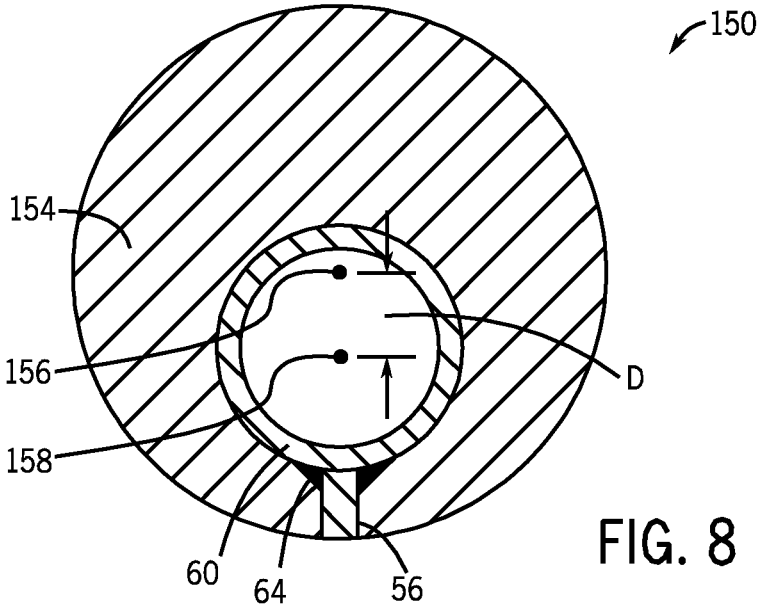
FIG. 8 is a cross-sectional view of a ball having an inner core that is eccentrically offset with respect to a center of mass of the ball according to an example implementation.

Referring to FIG. 8, the ball 150 is created by the use of at least one support structure 56, which is constructed to position the inner core, such as the inner core 60 described above, during the ball's fabrication so that a center of mass 158 of the inner core 60 is offset (offset by a distance D, as depicted in FIG. 8) relative to the overall center of mass 156 of the ball 150. Thus, the center of mass 158 of the inner core 60 is offset with respect to a center of mass of a surrounding outer layer 154, which induces rotation in the ball 150 due to the mass eccentricity as the ball 150 is pumped into the well.

Asymmetric dynamic characteristics may be imparted to a ball to affect the ball's rotation using techniques other than techniques that eccentrically position the inner core respect to the center of mass of the ball, in accordance with further implementations. For example, in accordance with further implementations, the outer surface of the ball may be partially texturized to induce more friction on one part of the outer surface of the ball, as compared to the other outer surface region(s) of the ball. This texturing creates an uneven drag, which leads to rotation of the ball. As examples, texturing may be created by roller burnishing, shot peening, friction stir processing, thermal spray processes, and so forth, as can be appreciated by the skilled artisan. Other techniques are envisioned, in accordance with further implementations, which impart desired rotational characteristics.

Figure 9:
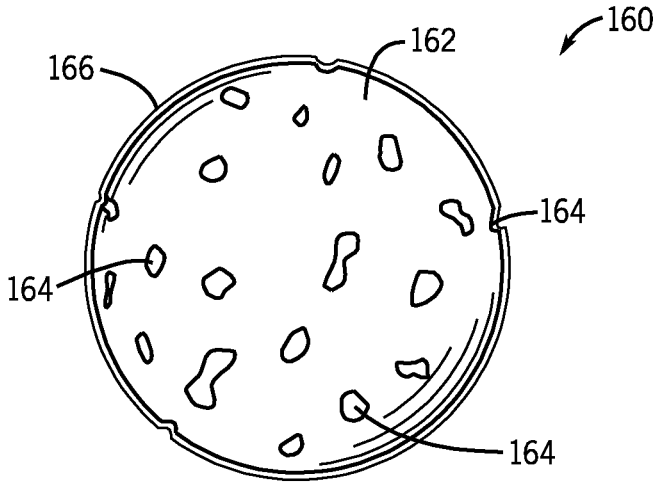
FIG. 9 is a perspective view of a foam material-based ball according to an example implementation.

FIG. 9 depicts a ball 160 that is formed from a foam-based material. As an example, the foam-based material may be a metal foam (formed from a lightweight metal-based foam, such as an aluminum foam, for example), which is formed by aerating the liquid metal/metal powder while the metal/metal powder cools inside a mold. The ball 160 has various air pocket-created voids 164, such as the voids 164 depicted in FIG. 9 as appearing on the outer surface of the ball 160. These voids 164 create a relatively low density, lightweight ball as well as impart rotational characteristics to the ball due to the asymmetrical weight distribution of the ball 162. In accordance with an example implementation, the outer surface of the ball 160 may be coated with a friction-reducing coating, such as Sol-gel, a spray coating of another friction reducing material, or a metal powder, as examples.

Figure 10:
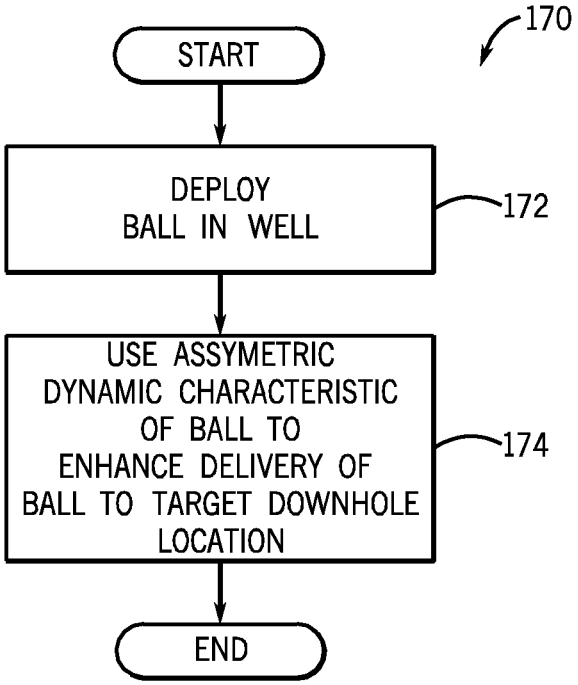
FIG. 10 is a flow diagram depicting a technique to regulate a delivery of a ball into a well according to an example implementation.

Thus, referring to FIG. 10, a technique 170 includes deploying (block 172) an obstruction forming ball in a well and using (block 174) an asymmetric dynamic property of the ball to regulate the delivery of the ball to a target downhole location, pursuant to block 174.

Other implementations are contemplated and are within the scope of the appended claims. For example, in accordance with further implementations, the inner core may have a shape other than a spherical-type shape, which supports the outer layer(s) of the ball while maintaining a lightweight inner core.

Figure 11:
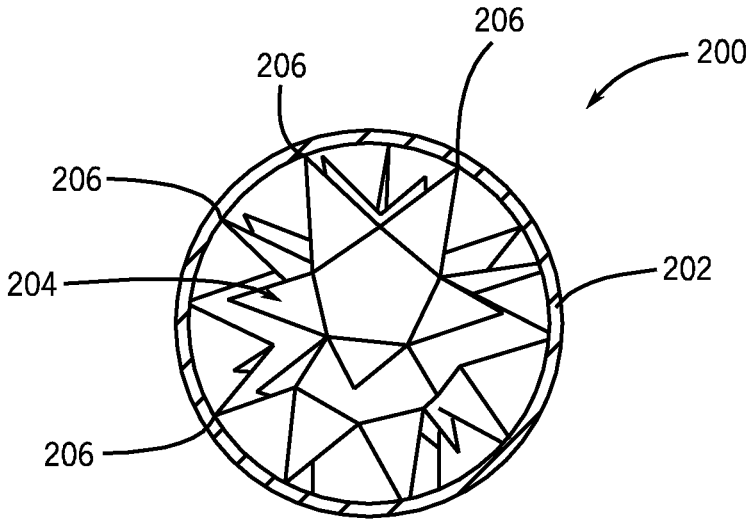
FIG. 11 is a schematic view of a ball that contains an internal support structure to support a surrounding outer layer of the ball according to an example implementation.

For example, FIG. 11 depicts a ball 200 that has an inner, star-shaped structure 204 that has various contact points 206 that extend radially outwardly to contact certain support points of the interior surface of the most adjacent outer layer 202 of the ball 200. The star-shaped structure 204 provides sphere-shaped support envelope, while maintaining a relatively low density, as compared to a corresponding spherical-shaped support structure, for example. The structure 204 may or may not be degradable, depending on the particular implementation.

Figure 12:
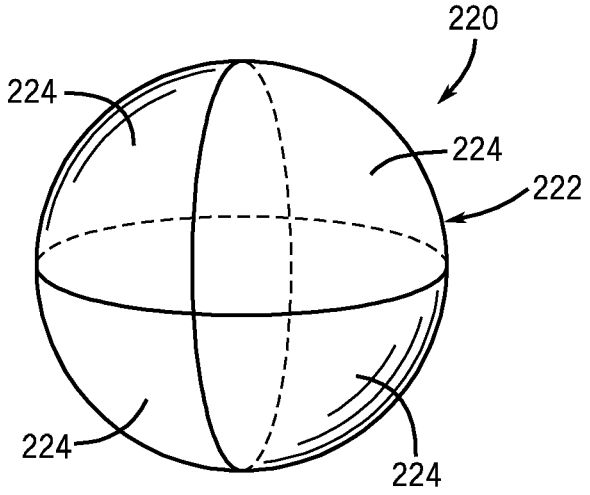
FIG. 12 is a perspective view of a ball formed from multiple interconnected partially spherical pieces according to an example implementation.

An obstruction forming object may be made using fabrication technologies other than casting or sintering, in accordance with further implementations. For example, FIG. 12 depicts a ball 220 that, in general, is formed from multiple partially spherical-shaped parts 224. For the example in FIG. 12, the parts 224 are identical and form a corresponding quadrant of a spherical shell. In accordance with example implementations, the parts 224 may have interlocking tabs, or teeth (not shown in FIG. 12). A particular advantage with using identical parts is that the parts may be readily manufactured from the same mold, and in general, may be readily assembled together to form the ball.

Figure 13:
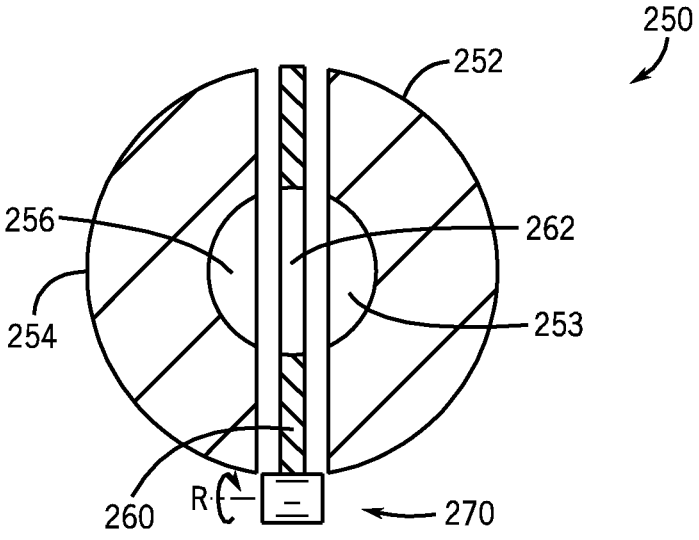
FIG. 13 illustrates a fabrication process to friction weld parts of a ball together according to an example implementation.

As another example of a way to fabricate a ball, a ball may be formed by frictionally welding partially spherical pieces together. For example, FIG. 13 schematically depicts a ball fabrication process 250 that involves frictionally welding two half spherical pieces 252 and 254 together using an intervening substantially flat disk plate 262. In this regard, the disk plate 262 may be rotated (via a roller 270, for example) with respect to two of the relatively stationary half spherical pieces 252 such that frictional contact between the half spherical pieces 252 and either side of the plate 262 creates sufficient thermal energy to form corresponding welds between the half spherical pieces 252 and 254 and the plate 262. Thus, the end product ball contains the two half spherical pieces 252 and 254 and the intervening plate 262, which are all friction-welded together. In further implementations, the half spherical pieces 252 and 254 may be rotated, and the plate 262 may be stationary in the friction welding process. Thus, many implementations are contemplated, which are within the scope of the appended claims.

Figure 14:
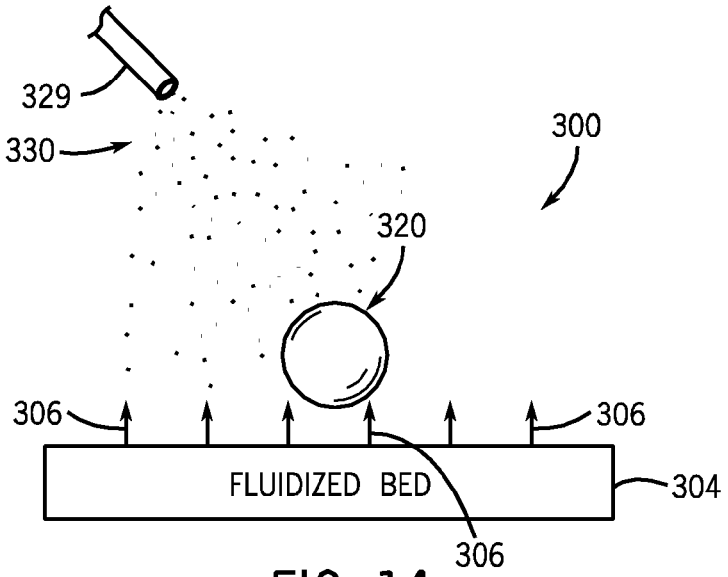
FIG. 14 is an illustration of a system to form a ball using a fluidized bed according to an example implementation.

As an example of another technique to fabricate an obstruction forming object, FIG. 14 depicts a ball fabrication process 300 that uses a fluidized bed 304 to suspend an inner core while the inner core is spray coated to form one or multiple outer layers. In this regard, as an example, the fluidized bed 304 may direct upwardly oriented fluidized jets 306 (jets of air, for example) for purposes of suspending an object 320, such as a sphere, that is used as a support structure to form the ball. The object 320 may also form an inner core of the ball, in further implementations. In this regard, as shown in FIG. 14, the object 320 may be suspended above the fluidized bed 304, and while the object 320 is suspended, a material may be deposited, such as being delivered by a spray 330 as depicted in FIG. 14, by an appropriately positioned spray nozzle 329. As an example, the spray 330 may be a solution or suspension of a binder and metallic powder. At the end of the process, a spherical outer layer is created that surrounds the object 320.

In accordance with some implementations, the inner object 320 may be formed from a material (wax or a polymeric material, as example) that may be melted, or dissolved, when thermal energy is applied. Thus, a further step in the fabrication of the ball may involve heating, or applying thermal energy in the intermediate stage of the ball fabrication process to melt the inner object 320, which then may escape through pores of the outer layer. Likewise, heating, or applying thermal energy to, the intermediate structure may, for example, melt a binder of the applied material. For the example above in which the spray 330 applies a solution or suspension of a binder with metal power, for example), thermal energy may be applied to melt the binder and possibly melt the inner object 320. The melted binder and/or inner object material escapes though pores of the outer metal powder. The metal powder may then be sintered just below its melting point to create a mechanically stable ball.

Figure 15:
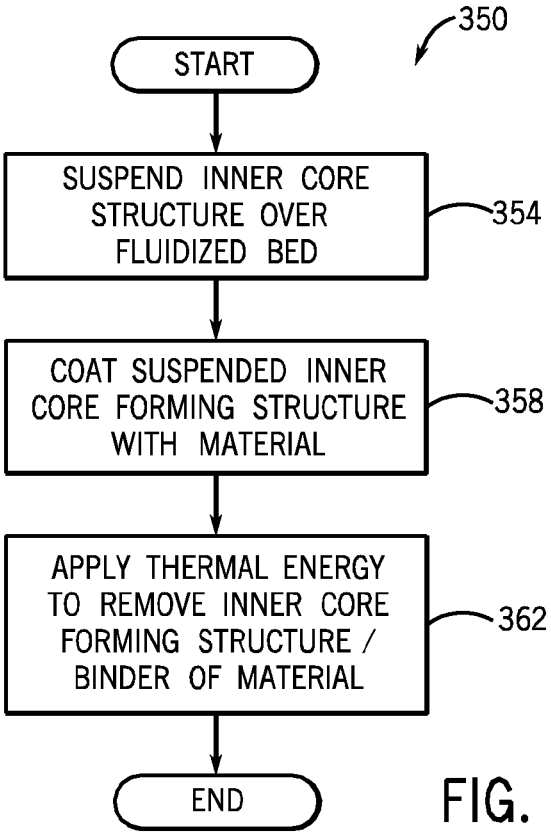
FIG. 15 is a flow diagram depicting a technique to form a ball using a fluidized bed according to an example implementation.

Thus, referring to FIG. 15, in accordance with an example implementation, a technique 350 to fabricate an obstruction forming object includes suspending (block 324) an inner core forming structure over a fluidized bed and coating (block 358) the suspended, inner core forming structure with an outer material. Thermal energy may then be applied, pursuant to block 362, to remove the inner core forming structure and/or remove the binder of the outer material.

Figure 16:
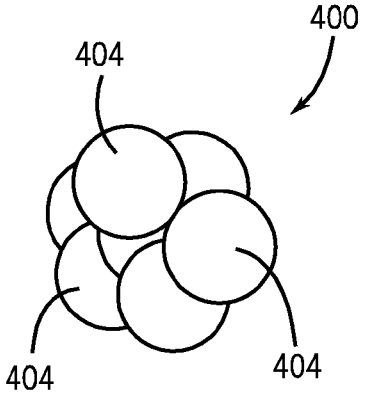
FIG. 16 is a perspective view of an object formed from a cluster of balls according to an example implementation.

In accordance with further implementations, an obstruction forming object may be formed from a cluster of multiple connected objects that each has a center of mass that is eccentric with respect to the center of mass of the cluster. For example, the objects may general sphere-shaped objects. FIG. 16 depicts an object 400 that is formed from a cluster of balls 404, where each ball 404 has an associated center of mass that is offset from the center of mass of the cluster.

Other implementations are contemplated, which are within the scope of the appended claims. For example, in accordance with further implementations, a multiple layer, hollow ball may be fabricated having a removable plug that extends through the outer layer(s) of the ball. The plug may be used as an access port for introducing a relatively low density filler material (ball clusters, relatively small balls, a polymer, a ceramic or a metal foam, as examples) into an inner space of the ball.

While a limited number of examples have been disclosed herein, those skilled in the art, having the benefit of this disclosure, will appreciate numerous modifications and variations therefrom. It is intended that the appended claims cover all such modifications and variations

What is claimed is:

1. An apparatus usable with a well, comprising:
- a string comprising a passageway; and
- an object adapted to be communicated into the well through the passageway to form an obstruction downhole in the well, the object comprising:
  - an inner core;
  - a layer to surround the inner core; and
  - a structure to extend from the layer to support the inner core while the layer is being formed to eccentrically position a center of mass of the inner core with respect to the center of mass of the layer.

2. The apparatus of claim 1, wherein the structure comprises at least one rod to radially extend from the layer to the inner core.

3. The apparatus of claim 1, wherein the layer comprises a material adapted to degrade downhole in an environment of the well.

4. The apparatus of claim 1, wherein the layer has a first density and the inner core has a second density less than the first density.

5. The apparatus of claim 1, wherein:
- the layer comprises a material adapted to degrade downhole in the presence of a downhole well environment; and
- the inner core comprises a frangible material adapted to fragment into a plurality of pieces in response to the degradation of the layer.

6. The apparatus of claim 1, wherein the inner core contains an inner hollow space.

7. The apparatus of claim 1, wherein the inner core comprises at least one of the following: a ceramic material; a metallic foam; and a ceramic foam.

8. The apparatus of claim 1, wherein the structure comprises a degradable structure.

9. The apparatus of claim 8, wherein the structure comprises an Al—Ga-based alloy or an Al—Mg-based alloy.

10. The apparatus of claim 1, further comprising at least one additional layer to surround the inner core.

11. The apparatus of claim 1, wherein the layer comprises a metal formed from a metal melting process or a metal formed from a metal casting process.

12. The apparatus of claim 1, wherein the inner core is adapted to provide internal support for the layer.

13. The apparatus of claim 12, wherein the inner core comprises protrusions to radially extend to contact the layer at a plurality of contact positions.

14. The apparatus of claim 1, wherein the layer comprises multiple pieces.

15. The apparatus of claim 14, wherein the multiple pieces are substantially identical.

16. The apparatus of claim 1, wherein the outer layer comprises a unitary body.

17. The apparatus of claim 1, wherein the layer comprises a metal foam, the apparatus further comprising:

a coating applied to the metal foam.

18. The apparatus of claim 17, wherein the coating comprises Sol-gel, a spray-applied coating, or a metal powder.

19. An apparatus, comprising:

a string comprising a passageway; and an object adapted to be communicated into a well through the passageway to form an obstruction downhole in the well, the object comprising:

an inner core; and at least one layer molded about the inner core, wherein the inner core is eccentrically positioned with respect to the at least one layer to impart a rotation to the object as the object is communicated into the well to regulate delivery of the object downhole.

20. An apparatus usable with a well, comprising:

a string to be deployed in the well, the string comprising a passageway; and an object to be deployed downhole to form an obstruction in the string, the apparatus comprising:

a foam-based material having air pocket voids on the outer surface of the object to impart rotational characteristics due to asymmetrical distribution of the object's mass.

* * * * *